US005891062A

United States Patent [19]

Schock et al.

[11] Patent Number: 5,891,062

[45] **Date of Patent: *Apr. 6, 1999**

[54] ACTIVE COMPRESSION/DECOMPRESSION DEVICE AND METHOD FOR CARDIOPULMONARY RESUSCITATION

[75] Inventors: Robert B. Schock; John J. Lucas, both of Sparta, N.J.

[73] Assignee: Datascope Investment Corp., Montvale, N.J.

[ * ] Notice: The term of this patent shall not extend beyond the expiration date of Pat. No. 5,630,789.

[21] Appl. No.: 728,915

[22] Filed: Oct. 11, 1996

Related U.S. Application Data

[63] Continuation of Ser. No. 319,559, Oct. 7, 1994, Pat. No. 5,630,789.

[51] Int. Cl.[6] ..... A61H 31/00

[52] U.S. Cl. ..... 601/41; 601/1; 601/135

[58] Field of Search ..... 601/1, 41, 42, 601/44, 84, 89, 94, 107, 134, 135; 434/262, 265

[56] References Cited

U.S. PATENT DOCUMENTS

| | | |
|---|---|---|
| 1,050,836 | 1/1913 | Jones . |
| 1,091,310 | 3/1914 | Dunn . |
| 2,071,215 | 2/1937 | Petersen . |
| 2,529,258 | 11/1950 | Lobo . |
| 2,869,537 | 1/1959 | Chu . |
| 3,219,031 | 11/1965 | Rentsch, Jr. . |
| 3,509,899 | 5/1970 | Hewson . |
| 3,745,998 | 7/1973 | Rose . |
| 3,896,797 | 7/1975 | Bucur . |
| 4,166,458 | 9/1979 | Harrigan . |
| 4,248,215 | 2/1981 | Bleakley . |
| 4,397,306 | 8/1983 | Weisfeldt et al. . |
| 4,424,806 | 1/1984 | Newman et al. . |
| 4,753,226 | 6/1988 | Zheng et al. . |
| 4,862,879 | 9/1989 | Coombs . |
| 4,928,674 | 5/1990 | Halperin et al. . |
| 4,971,042 | 11/1990 | Lerman . |
| 5,222,478 | 6/1993 | Scarberry et al. . |
| 5,487,722 | 1/1996 | Weaver, II et al. . |
| 5,490,820 | 2/1996 | Schock et al. . |

FOREIGN PATENT DOCUMENTS

| | | | |
|---|---|---|---|
| 651189 | 10/1992 | Australia | 601/41 |
| 1225889 | 8/1987 | Canada . | |
| 0509773 | 10/1992 | European Pat. Off. . | |
| 779875 | 4/1935 | France . | |
| 2045451 | 2/1971 | France . | |
| 2286641 | 4/1976 | France . | |
| 2624008 | 6/1989 | France . | |
| 624118 | 1/1936 | Germany . | |
| 673551 | 3/1939 | Germany . | |
| 1560204 | 4/1990 | Russian Federation . | |

OTHER PUBLICATIONS

Lueptow, et al, "Circulatory Model Studies of External Cardiac Assist by Counterpulsation," Cardiovascular Research, vol. XV, No. 8, Aug. 1981, pp. 443–455.

Chandra, Nisha, et al., "Augmentation of Carotid Flow During Cardiopulmonary Resuscitation by Ventilation at High Airway Pressure Simultaneous with Chest Compression," John Hopkins Hospital, 1981.

Lueptow, R.M. et al., "Study of Four Modes of Counterpulsative External Cardiac Assist," Trans. Am. Soc. Artif. Intern. Organs, vol. XXVII, 1981, pp. 576–581.

Weisfeldt, Myron L. et al., "Physiology of Cardiopulmonary Resuscitation," Ann. Rev. Med., vol. 32, 1981, pp. 35–42.

(List continued on next page.)

*Primary Examiner*—Jeanne M. Clark

*Attorney, Agent, or Firm*—Fitzpatrick, Cella, Harper & Scinto

[57] ABSTRACT

An active compression/decompression CPR device includes two pressure members mounted on a common beam. When placed on the victim with one member on the chest and the other on the abdomen, pressure on one end of the beam causes compression of the thorax and decompression of the abdomen. Conversely, when pressure is applied to the other end of the beam, the abdomen is compressed and the thorax is decompressed.

27 Claims, 4 Drawing Sheets

OTHER PUBLICATIONS

Koehler, et al, "Augmentation of Cerebral Perfusion by Simultaneous Chest Compression and Lung Inflation with Abdominal Binding After Cardiac Arrest in Dogs," Circulation, vol. 67, No. 2, Feb. 1983, pp. 266–275.
Pinsky, et al. "Augmentation of Cardiac Function by Elevation of Intrathoracic Pressure," J. Appl. Physiol., vol. 54, No. 54, 1983, pp. 950–955.
Beyar, Rafael, et al., "Cardiopulmonary Resuscitation by Intrathoracic Pressure Variations: In Vivo Studies and Computer Simulation," Vascular Diseases, Feb. 1984, pp. 71–78.
Maier, George W. et al., "The Physiology of External Cardiac Message: High Impulse Cardiopulmonary Resuscitation," Circulation, vol. 70, No. 1, Jul. 1984, pp. 86–101.
Criley, J. Michael et al., "Cardiopulmonary Resuscitation Research 1960–1984: Discoveries and Advances," Annals of Emergency Medicine, vol. 13, No. 9, Sep. 1984, pp. 756–758.
Niemann, James T. et al., "Circulatory Support During Cardiac Arrest Using a Pneumatic Vest and Abdominal Binder with Simultaneous High–Pressure Airway Inflation," Annals of Emergency Medicine, vol. 13, No. 9, Sep. 1984, pp. 767–769.
Luce, John M. et al., "Regional Blood Flow During Cardiopulmonary Resuscitation in Dogs," Critical Care Medicine, vol. 12, No. 10, Oct. 1984, pp. 874–948.
Sanders, Arthur B. et al., "The Physiology of Cardiopulmonary Resuscitation," JAMA, vol. 252, No. 23, Dec. 1984, pp. 3283–3286.
Beyar, R. et al., "Noninvasive Cardiac Assist by Extension of Phased Compression Cardiopulmonary Resuscitation," Trans. Am. Soc. Artif. Intern. Organs, vol. XXX, 1984, pp. 103–107.
Cummins, Richard O. et al., "Prehospital Cardiopulmonary Resuscitation: Is It Effective?" JAMA, vol. 253, No. 16, Apr. 1985, pp. 2408–2412.
Soroff, Harry S. et al., "Current Status of External Counterpulsation," Critical Care Clinics, vol. 2, No. 2, Apr. 1986, pp. 277–295.
Weisfeldt, Myron L. et al., "Cardiopulmonary Resuscitation: Beyond Cardiac Message," Circulation, vol. 74, No. 3, Sep. 1986, pp. 443–448.
Criley, John Michael et al., "Modifications of Cardiopulmonary Resuscitation Based on the Cough," Circulation, vol. 74, Suppl. IV, Dec. 1986, pp. IV–42–50.
Ewy, Gordon A., Alternative Approaches to External Chest Compression, Circulation, vol. 74, Suppl. IV, Dec. 1986, pp. IV–98–101.
Halperin, Henry R. et al., "Vest Inflation Without Simultaneous Ventilation During Cardiac Arrest in Dogs: Improved Survival from Prolonged Cardiopulmonary Resuscitation," Circulation, vol. 74, No. 6, Dec. 1986, pp. 1407–1415.
Paraskos, John A., "External Compression Without Adjuncts," Circulation, vol. 74, Supp. IV, Dec. 1986, pp. IV–33–36.
Chandra, Nisha C. et al., "Vital Organ Perfusion During Assisted Circulation by Manipulation of Intrathoracic Pressure," Circulation, vol. 84, No. 1, Jul. 1991, pp. 279–286.
Kern, Karl B. et al., "Comparison of Mechanical Techniques of Cardiopulmonary Resuscitation," Am. J. Emergency Medicine, vol. 5, No. 3, May 1987, pp. 190–195.
Lin, Ching–Kow et al., "Optimization of Coronary Blood Flow During Cardiopulmonary Resuscitation (CPR)," IEEE Trans. Biomedical Engineering, vol. BME–34, No. 6, Jun. 1987, pp. 473–481.
Halperin, H.R. et al., "Programmable Pneumatic Generator for Manipulation of Intrathoracic Pressure," IEEE Trans. Biomedical Engineering, vol. BME–34, No. 9, Sep. 1987, pp. 738–742.
Newton, Joseph R. et al., "A Physiologic Comparison of External Cardiac Messages Techniques," J. Thoracic and Cardiovascular Surgery, vol. 5, No. 5, May 1988, pp. 892–901.
Swenson, Robert D. et al., "Hemodynamics in Humans During Conventional and Experimental Methods of Cardiopulmonary Resuscitation," Circulation, vol. 78, No. 3, Sep. 1988, pp. 630–639.
Deshmukh, H. et al, "Mechanism of Blood Flow Generated by Precordial Compression During CPR," Chest, vol. 95, No. 5, May 1989, pp. 1092–1099.
Richardson, W. et al. "A Novel Cervical Dilatation Force Measurement Instrument", J. Medical Eng. & Techn., vol. 13, No. 4 (Jul./Aug. 1989), pp. 220–221.
Ben–Haim, Shlomo A. et al., "A Computer Controller for Vest Cardiopulmonary Resuscitation (CPR)," IEEE Trans. Biomedical Engineering, vol. 35, No. 5, May 1988, pp. 413–416.
Ranu, H. "An Evaluation of the Centre of Pressure for Successive Steps With Miniature Triaxial Load Cells", J. Medical Eng. & Techn., vol. 12, No. 4 (Jul./Aug. 1988), pp. 164–166.
Brochure, "Sequential External Counterpulsation for the Treatment of Ischemic Heart Disease," Cardiomedics, Inc., Mar. 1990.
Weil, Max Harry et al., "The Clinical Rationale of Cardiopulmonary Resuscitation," Disease–a–Month, Aug. 1990, pp. 423–468.
Beattie, Charles et al., "Mechanisms of Blood Flow During Pneumatic Vest Cardiopulmonary Resusitation," J. Appl. Physiol., 1991.
Kuhn, Clemens et al., "Evidence for the 'Cardiac Pump Theory,'" Resuscitation, vol. 22, 1991, pp. 275–282.
Cohen, Todd J., et al. "Active Compression–Decompression Resuscitation in Humans Improves Cardiopulmonary Circulation," JACC, vol. 19, No. 3, Mar. 1992, p. 27A.
"'Active Compression–Decompression Resuscitation' Investigated," Biomedical Technology Information Service, May 1992, p. 100.
Halperin, Henry. et al. "New Approaches to CPR," JAMA, vol. 267, No. 21, Jun. 3, 1992, pp. 2940–2941.
Cohen, Todd J. et al., "Active Compression–Decompression," JAMA, vol. 267, No. 21, Jun. 9, 1992, pp. 2918–2923.
Robertson, Colin et al., "Compression Techniques and Blood Flow During Cardiopulmonary Resuscitation," Resuscitation, vol. 24, 1992, pp. 123–132.
"Call a Plumber," The Practical Homeowner, Mar./Apr. 1993, p. 16.
Halperin, Henry R., et al. "A Preliminary Study of Cardiopulmonary Resuscitation by Circumferential Compression of the Chest . . . ", New England J. of Med., vol. 329, No. 11, pp. 762–768 (Sep. 9, 1993).
"CPR Vest Tested on Cardiac Arrest Victims", Adv. for Medical Laboratory Professionals (Oct. 18, 1993).

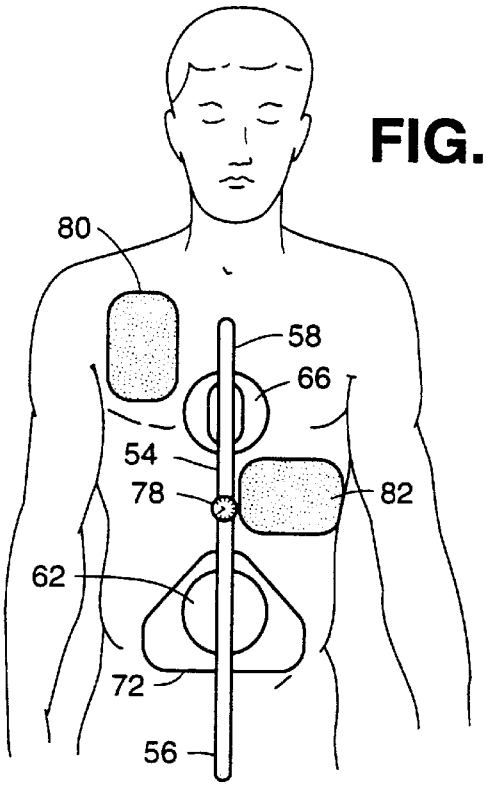
FIG. 4
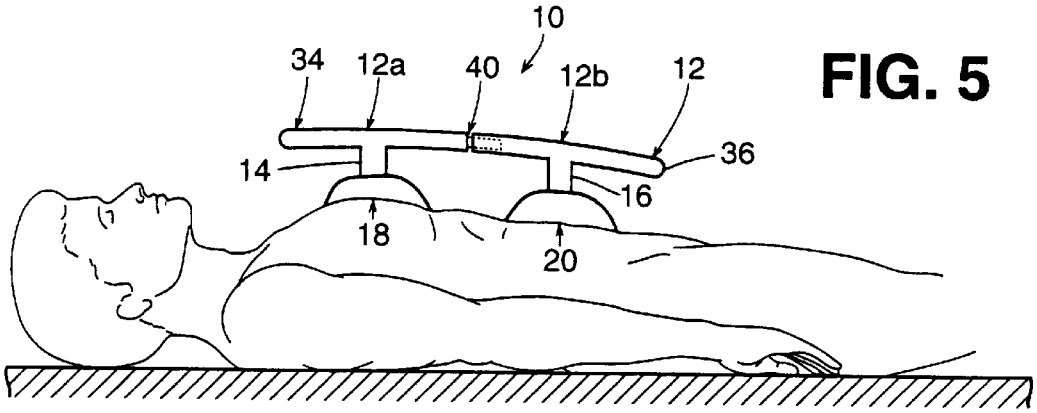
FIG. 5
FIG. 6
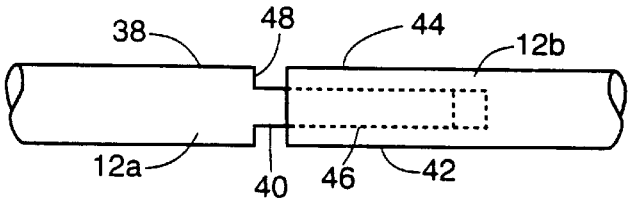

FIG. 7
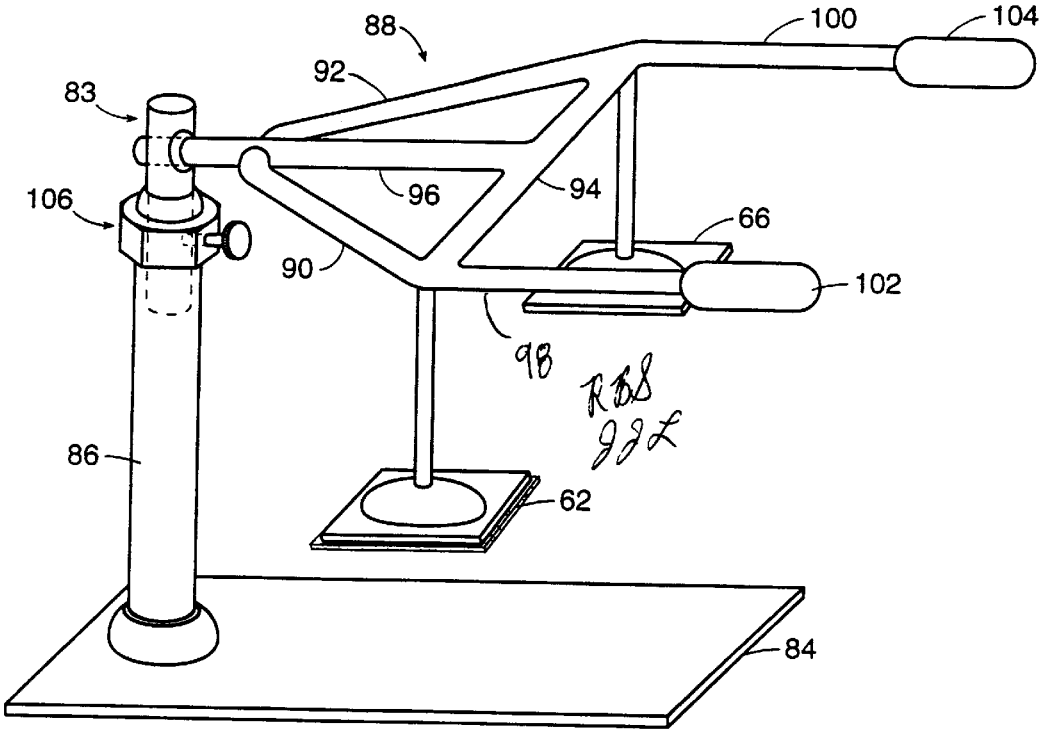
FIG. 8A
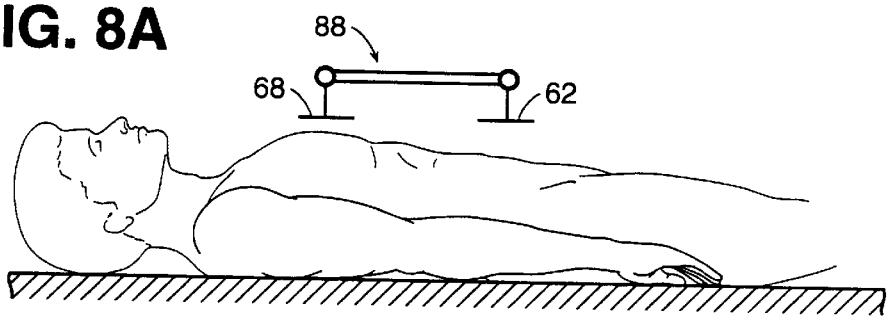
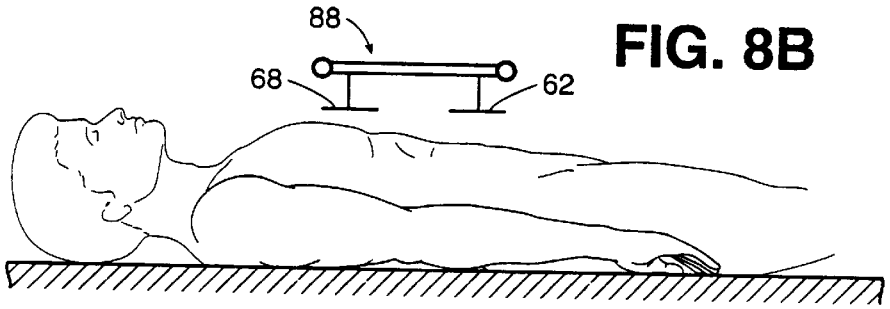
FIG. 8B

ACTIVE COMPRESSION/DECOMPRESSION DEVICE AND METHOD FOR CARDIOPULMONARY RESUSCITATION

This application is division of application Ser. No. 08/319,559 filed Oct. 7, 1994 now U.S. Pat. No. 5,630,789.

BACKGROUND OF THE INVENTION

1. Field of the Invention

This invention relates generally to cardiopulmonary resuscitation (CPR), and more particularly, to a device for performing CPR through alternating active compression and decompression of the thorax and abdomen.

2. Description of the Related Art

There are approximately 550,000 cases annually of cardiac arrest in the U.S. Despite advances in many other areas of medicine, the survival rate for these cases remains low. In general, for the victims to survive, it is essential that they receive proper resuscitation as soon as possible after the cardiac arrest. It is generally felt that in order for a victim to stand a reasonable chance for survival successful cardiopulmonary support must be established within ten minutes of cardiac arrest. Beyond this, any delay in providing support is likely to result in severe brain damage.

There are two general classes of cardiopulmonary support: invasive and non-invasive. Examples of invasive support devices include percutaneous bypass, direct coronary perfusion, the Anstadt cup, hemopumps, and intraortic balloon pumping. Of course since these techniques require the insertion of devices into the body, they can only be performed by trained medical personnel. In fact, these techniques are generally not suited for emergency life support outside a hospital. Even then, they generally take longer to establish than a person in cardiac arrest can ordinarily tolerate.

Non-invasive devices tend to be easier and less expensive to use and faster to implement than the invasive equipment. Non-invasive support techniques include cardiopulmonary resuscitation (CPR), leg compression, and THUMPER® devices or compression vests which mechanically compress the chest to simulate CPR. Traditional CPR provides cardiac support through a series of rhythmic compressions of the victim's thorax alternating with mouth-to-mouth ventilation. Thoracic compression is achieved by having the care giver place his or her hands on the victim's chest and pressing down. After compression has been achieved, thoracic pressure is released and mouth-to-mouth ventilation follows. The principle advantage of CPR is its relative simplicity. An individual can be trained to administer traditional CPR in only about 15 hours.

However, traditional CPR has its limitations. For one thing, it is tiring to administer. In addition, it is not very efficient, ordinarily providing insufficient cardiopulmonary support to sustain the patient until professional emergency medical care can be provided.

The THUMPER® devices and compressive vests now used for non-invasive life support have been designed to duplicate the movements used to perform CPR, the idea being to provide a mechanical substitute for a person trained to administer CPR. Examples of such devices can be found in U.S. Pat. No. 3,219,031, No. 3,509,899, No. 3,896,797, and No. 4,397,306. Each of these patents describe devices which use a reciprocable plungers to compress a victim's chest along with a means of ventilating the victim, such as a source of pressurized oxygen or a squeeze bag. However, such devices, because they are fairly complex and not easily used by untrained lay persons, are in fact less-than-ideal substitutes for a trained CPR administrator. Furthermore, they do not improve the hemodynamic efficiency of CPR.

As an alternative to the use of mechanical chest compressors, U.S. Pat. No. 2,071,215, No. 4,424,806 and No. 4,928,674 describe how to support the pulmonary and/or cardiac functions by providing an inflatable bladder around the patient's chest. In some cases, a stiff outer shell or biasing cuff surrounds the bladder so that when the bladder is periodically inflated, the patient's chest is compressed, causing expiration and inspiration.

Because none of the commercial embodiments of these devices is entirely satisfactory, CPR remains the most common resuscitative technique used by lay persons to treat cardiac arrest.

As indicated above, traditional CPR involves the use of the administrator's hands on the victim's chest followed by mouth-to-mouth ventilation. Compressing the thorax causes blood to circulate while the mouth-to-mouth ventilation ventilates the lungs. Recently certain hand held devices have been employed to serve both these functions. Indeed, the popular media have reported on the use of a suction cup plunger, often referred to as a "plumber's helper", having been used to provide enhanced CPR.

A recent study determined that where cardiac support is provided by rhythmic chest compressions, cardiac output can be significantly improved by alternating chest compressions with chest decompressions. In this study, the chest was compressed and decompressed using a rubber plunger which alternately applied pressure and suction to the patient's chest. See Cohen, T. J., et al., "Active Compression-Decompression: A New Method of Cardiopulmonary Resuscitation", J. Am. Med. Assoc. Vol. 267, No. 21, pp. 2916–23, 1992. This technique is known as active compression-decompression CPR ("ACD CPR").

ACD CPR is reported as being significantly more effective than conventional "compression-only" CPR. It provides both perfusion and ventilation, and can resuscitate some patients where conventional CPR and defibrillation fail.

Devices capable of being used to perform ACD CPR are also described in U.S. Pat. No. 5,295,481 and European Patent Application No. 92303367.4 (Publication No. 0 509 773 A1). Each of these patents shows a device which includes a suction cup and handle. In each case, the aid giver would grab the handle and alternately press down and then pull up. The downward pressure would force air out of the lungs and blood out of the heart while the pulling up on the handle would cause the suction cup to draw the chest upwardly to pull air into the lungs and blood into the heart.

Although the traditional manner of performing CPR involves only the thorax, it has also been suggested that simultaneous involvement of the abdomen might prove even more advantageous. In an article entitled "Optimization of Coronary Blood Flow During Cardiopulmonary Resuscitation (CPR)" by Lin et al. (IEEE Transactions on Biomedical Engineering, Vol. BME-34, No. 6, Jun. 1987) the authors describe a computer simulation of CPR. Based on that simulation they conclude that coronary blood flow could be significantly improved if, in addition to alternating positive and negative pressure on the thorax, negative and positive pressure could also be applied to the abdomen. In other words, their computer model suggests that when positive pressure is applied to the thorax, it should be accompanied by the application of negative pressure to the abdomen and, conversely, as negative pressure is supplied to the thorax, positive pressure should be applied to the abdomen. The Lin et al. paper, however, appears to be based solely on the authors' computer simulation, and no structure is suggested for applying these alternating positive and negative pressures.

As previously noted, emergency medical personnel have available to them a number of different ways to treat cardiac arrest. However, none of these techniques is entirely satisfactory. Thus, there is a need for a CPR resuscitation device which is simple, easy to use, and not harmful to patients. In particular there is need for such a device which will facilitate alternating application of positive and negative pressures on the thorax and abdomen.

SUMMARY OF THE INVENTION

The present invention involves a device for alternating compression of the thorax and decompression of the abdomen with decompression of the thorax and compression of the abdomen.

BRIEF DESCRIPTION OF THE DRAWINGS

FIG. 4 is a plan view of the device embodying the invention applied to the body of a victim.

FIG. 5 is a side view of a second alternative embodiment of a device of the invention applied to the body of a victim.

FIG. 6 is an exploded view of the mid-portion of the device depicted in FIG. 5.

FIG. 7 is a perspective view of a third alternative embodiment of a device of the invention applied to the body of a victim.

FIG. 8A is a side view schematic of the device and victim shown in FIG. 7.

FIG. 8B is a side view schematic of an alternate embodiment of the device depicted in FIG. 8A.

DESCRIPTION OF THE PREFERRED EMBODIMENTS

Figure 1:
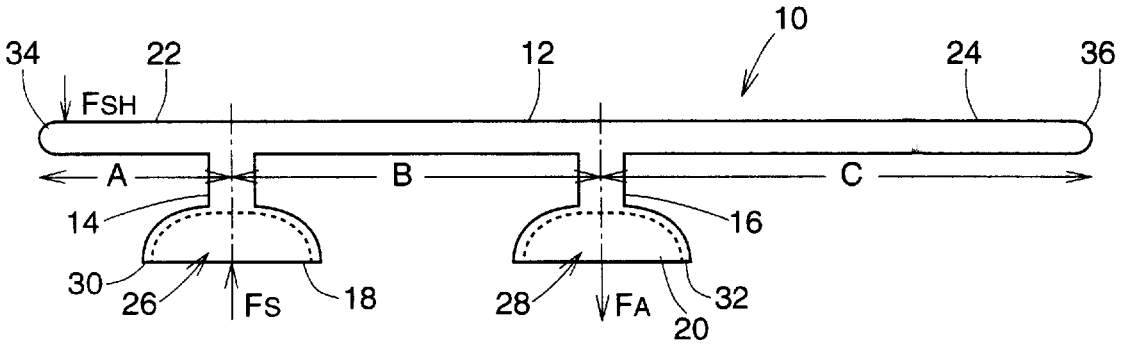
FIG. 1 is a side view of a device embodying the invention being used in the systolic mode.
Figure 2:
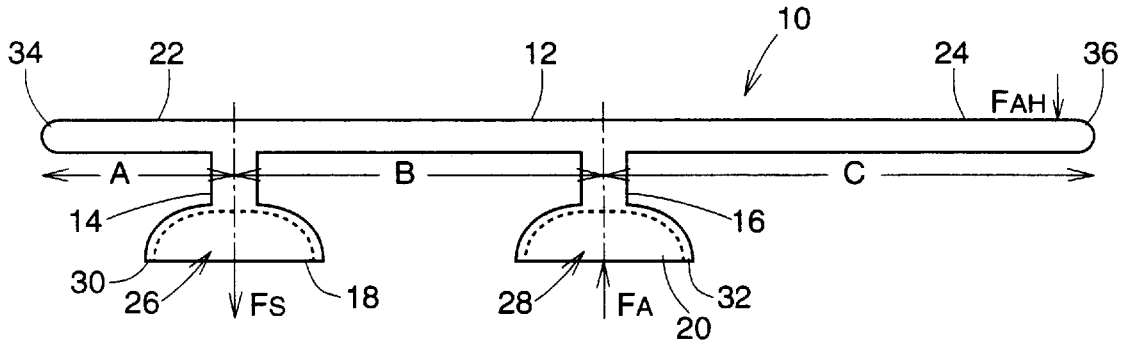
FIG. 2 is a side view of the same device shown in FIG. 1 but being used in the diastolic mode.

The CPR device 10 of a basic embodiment of the instant invention as depicted in FIGS. 1 and 2 is comprised of a support beam 12 having two depending vertical legs 14 and 16. Attached to the lower end of leg 14 is pressure member 18 and attached to the lower end of leg 16 is pressure member 20.

As depicted in FIGS. 1, 2 and 5, pressure members 18 and 20 are in the form of suction cups made of rubber or some other flexible material. Suction cups 18 and 20 are hollow so that when placed against the patient's chest and abdomen respectively they will trap air in their respective hollow chambers 26 and 28 with their rims 30 and 32 forming air-tight seals with the patient's chest and abdomen. In use, when the rim 30 of suction member 18 is placed on the patient's chest, because the suction member is flexible, a downward force applied through leg 14 will deform and force some of the air out of chamber 26. Rim 30 will then form an air-tight seal around chamber 26 preventing ambient air from reentering when the downward force is removed. An upward force can then be applied through leg 14 to lift the chest and cause decompression of the thorax. Similarly, suction member 20 can be attached in the same way to the patient's abdomen, although due to the greater flexibility of the abdomen a good seal may be more difficult to achieve.

As can be seen from FIGS. 1 and 2, legs 14 and 16 are not symmetrically located on support beam 12. Outboard of leg 14 is lever arm 22 and outboard of leg 16 is lever arm 24. The end of each lever arm can be used as a handle for the care giver to grasp. Leg 14 is located at a distance A from one end of support beam 12, while leg 16 is located at a distance C from the opposite end of beam 12. Distance C is preferably longer than distance A. Legs 14 and 16 are separated from one another by a distance B, preferably about 8 inches which is believed to be the distance between the middle of the thorax and the middle of the abdomen of an average-size person. Obviously, the total length of support beam 12 is A+B+C.

When it is determined that CPR is called for, the operator first attaches suction members 18 and 20 to the patient's chest and abdomen as described above. Downward force $F_{SH}$ is then applied to end 34 (the sternum handle) of beam 12 (FIG. 1) and then released. Next, downward force $F_{AH}$ is applied to end 36 (the abdominal handle) of beam 12 (FIG. 2) and that force is then released. This procedure is repeated, alternating application of force $F_{SH}$ on end 34 with application of force $F_{AH}$ on end 36 until it is determined that CPR is no longer needed.

In the course of applying CPR using device 10, the application of force $F_{SH}$ to end 34 (FIG. 1) results in the application of downward force $F_s$ on leg 14. With the lowermost portion of leg 14 acting as a fulcrum, the application of a downward force $F_{SH}$ to end 34 tends to raise leg 16 with an upward force of $F_A$ on the abdomen. When the force $F_S$ is downward, the sternum is being compressed and when the force $F_A$ applied to the abdomen is upward, the abdomen is being decompressed. Thus, downward force $F_{SH}$ on end 34 simultaneously compresses the thorax and decompresses the abdomen.

In the next phase (FIG. 2), when downward force $F_{AH}$ is applied to end 36, it is the lower end of leg 16 which acts as a fulcrum. Thus, a downward force $F_{AH}$ on end 36 causes a downward force $F_A$ to be applied through leg 16 to compress the abdomen and an upward force $F_s$ through leg 14 to be applied to lift and decompress the thorax.

Based upon CPR literature as well as additional data, it is believed that during CPR simulation of systole (chest compressed and abdomen decompressed) (FIG. 1), force $F_s$ should be about 100 lb. while force $F_A$ should be about −30 lb. In the diastole mode (chest decompressed and abdomen compressed) (FIG. 2) force $F_s$ should be about −30 lb. and force $F_A$ about 50 lb. Using these figures

| Systole mode (FIG. 1) | Diastole mode (FIG. 2) |
|---|---|
| $F_{AH}$ = 0 | $F_{SH}$ = 0 |
| $F_S$ = 100 lb. | $F_S$ = −30 lb. |
| $F_A$ = −30 lb. | $F_A$ = 50 lb. |
| B = 8 inches | B = 8 inches |

and solving the force and moment equations for the unknowns $F_{SH}$, $F_{AH}$, A and C, the length A of lever arm 22 is 3.42 inches, the length C of lever arm 24 is 12 inches, the force $F_{SH}$ during systole simulation is about 70 lb and the force $F_{AH}$ during diastole is about 20 lb. This means that the overall length of support beam 12 is less than two feet, an overall dimension which makes it easy to store and convenient to carry to the victim. It also means that the care giver need never exert more than about 70 lbs. of force, something which should be easily manageable for almost any adult and most teenagers as well.

A care giver would use the device having the above dimensions by first placing suction member 18 on the victim's chest and suction member 20 on the victim's abdomen. Both suction members would then be compressed against the victim to establish good seals. The care giver would then grasp support beam 12 with both hands, one hand being on the sternum handle at end 34 and the other hand being on the abdominal handle at the other end 36. Then, by use of a rocking motion, first one hand would exert a downward force of 70 lb. at end 34 (FIG. 1) then, the second hand would exert a downward force of about 20 lb. at end 36 (FIG. 2). This alternating application of force by one hand then the other would be repeated over and over again as long as needed.

An alternative embodiment of the instant invention is depicted in FIGS. 5 and 6. In this embodiment the support beam 12 is made up of two mating segments 12*a* and 12*b*. Segment 12*a* itself is comprised of two portions, a left portion 38 and a right portion 40. The cross section of right portion 40 is smaller than that of portion 38 and there is a shoulder 48 formed where portion 38 meets portion 40.

Segment 12*b* is also comprised of two portions, a left portion 44 and a right portion 42. Right portion 42 is solid whereas left portion 44 has a hollowed out recess 46 which is designed to receive therein right portion 40 of segment 12*a*. This arrangement whereby portion 38 can slide within hollowed out recess 42 permits adjusting the distance between suction members 18 and 20 to accommodate persons of different sizes.

In the embodiment of FIG. 5, legs 14 and 16 are equidistant from ends 34 and 36 respectively.

The embodiment of FIG. 5 would be employed in a manner somewhat different from that of the prior embodiment. Using the FIG. 5 embodiment, the care giver would first adjust the length of beam 12 so as to place suction member 18 over the middle of the victim's thorax and suction member 20 over the middle of the victim's abdomen. Both suction members would then be attached by suction to the victim as described with reference to the prior embodiment. A downward force would then be applied by one hand to the handle at end 34 while, at the same time, an upward force would be applied by the other hand on the handle at end 36. Next, an upward force would be applied to end 34 while a downward force would be applied to end 36. Once again, as described above, this rocking motion would be repeated over an over again as long as needed.

Figure 3:
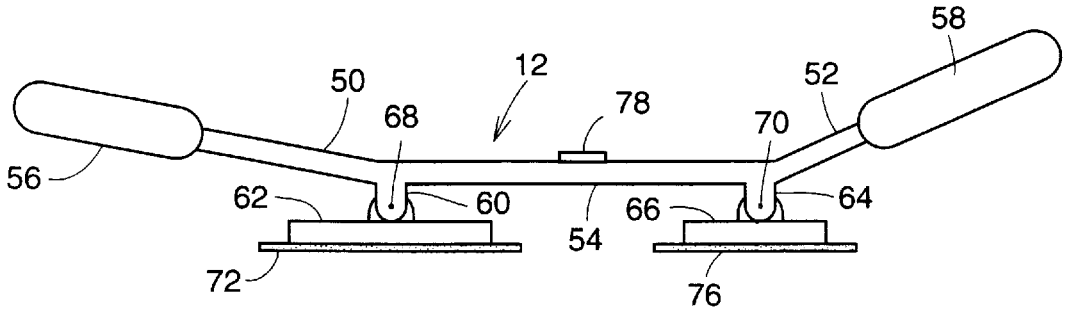
FIG. 3 is a side view of an alternative embodiment of a device of the invention.

The alternative embodiment of FIG. 3, is comprised of support beam 12 having a abdominal lever 50 at one end and a sternal lever 52 at the other end. Between levers 50 and 52 is connecting rod 54. At the outboard end of lever 50 is abdominal handle 56 and at the outboard end of lever 52 is sternal handle 58.

Depending from the abdominal end of connecting rod 54 is leg 60 to which is attached pressure pad 62. Depending from the sternal end of connecting rod 54 is leg 64 to which is attached pressure pad 66. Pad 62 is pivoted about pin 68 at the lower end of leg 60 and pad 66 is pivoted about-pin 70 at the lower end of leg 64. On the bottom of pressure pad 62 is adhesive pad 72 while the bottom face 76 of pressure pad 66 is also provided with an adhesive surface. In this embodiment, the air-tight seals with the thorax and the abdomen would be established by use of adhesives. For sanitary purposes, adhesive pad 72 and bottom face 76 of pressure pad 66 can be made of materials which can be removed and disposed of after each use.

Finally, the embodiment of FIG. 3 is provided with a force gauge 78, preferably with two read outs, one for the abdomen and the other for the thorax. Alternatively, two separate force gauges could be employed.

In use, the care giver would first place fresh adhesives on pads 62 and 66. The adhesive-faced pads would then be placed on the victim's thorax and abdomen and a good seal established for each.

The care giver would then place his or her hands on handles 56 and 58 and begin the application of force by means of a rocking motion as described above. The force gauge 78 would be used to provide feedback so that the care giver can monitor the amount of force being applied.

As can be seen, levers 50 and 52 are not coaxial with connecting rod 54. Rather, each lever forms an angle with the connecting rod, with sternal lever 52 being offset more than abdominal handle 50. By offsetting levers 50 and 52 from the horizontal, the handles 56 and 58 and hence the care giver's hands are raised away from the victim's body. This arrangement reduces the likelihood that the care giver's hands will come in contact with the victim during the rocking motion.

As can be seen in FIG. 4, the instant invention could easily be used in conjunction with defibrillation. For such application, defibrillation pads 80 and 82 could be placed on the victim as shown and the device according to the present invention applied to the victim without interfering with the defibrillation pads. ACD CPR could then follow immediately after attempted defibrillation and ACD CPR could easily be interrupted for defibrillation and then immediately resumed, if necessary.

In addition to defibrillation, ACD CPR using a device in accordance with the instant invention could very easily be augmented by forced ventilation using conventional means and techniques.

FIGS. 7, 8 and 9 depict several variations of yet another embodiment of the instant invention, this one permitting application of force from beside the victim rather than from directly above. This embodiment comprises a backboard or frame 84 which is designed to be slid under the body of the victim to stabilize the device. Backboard 84 is connected to a fixed vertical post 86. A sliding vertical top post 83 telescopes into vertical bottom post 86 for vertical adjustment. Locking ring 106 secures vertical posts 86 and 83 together.

Top frame 88 is made in the form of a triangle having legs 90 and 92, a base 94 and a pivoting rib 96. As shown in FIG. 7, the tip of pivoting rib 96 projects slightly beyond the apex of the triangle where the legs and rib meet. Underneath or adjacent to each apex where legs 90 and 92 meet base 94 there is a pressure pad (62 and 66) and extending horizontally from these apexes are extension arms 98 and 100. At the end of arms 98 and 100 are handles 102 and 104 respectively.

Frame 88 pivots about the longitudinal axis of rib 96 to accommodate the rocking motion which alternates downward pressure between pads 62 and 66. Typically, a bearing at the junction of sliding vertical post 83 and rib 96 permits rotation of the rib 96 relative to the sliding vertical top post 83.

A slightly different configuration of this embodiment is shown in FIG. 8B; there, pads 62 and 66 are moved inward somewhat from their position in FIG. 8A. This embodiment might be useful for resuscitating smaller victims.

These embodiments would be used by first slipping backboard 84 under the victim (FIG. 9A) or care giver (FIG. 9B) so that pads 62 and 66 are properly located over the victim's abdomen and thorax respectively. The care giver would then grab the handles and apply downward force on handle 104. This would then be followed by applying downward force on handle 102. Added force could be applied by pulling up on handles 102 and 104, respectively. As described previously, the rocking action would be repeated as long as needed.

Figure 9A:
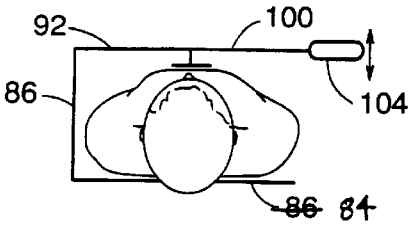
FIG. 9A is an end view schematic of the device and victim shown in FIG. 7.
Figure 9B:
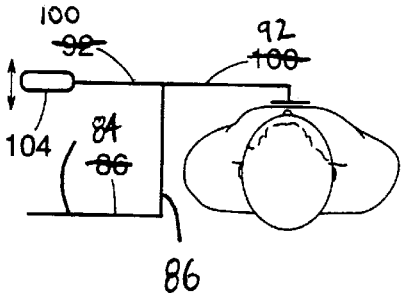
FIG. 9B is an end view schematic of an alternate embodiment of the device and victim shown in FIG. 9A.

In the case of FIG. 9B, the basic set-up is generally similar to FIG. 9A save that arm 100 and handle 104 and backboard 84 are shifted by 180°, as shown. Now, the care giver approaches the victim from his left side; the weight of the care giver's body on backboard 84 provides stability for the frame.

Figure 10A:
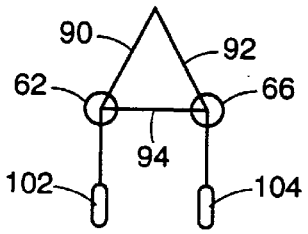
FIGS. 10A–10E depict a series of alternative configurations of the top frame portion of the device of FIG. 7.
Figure 10B:
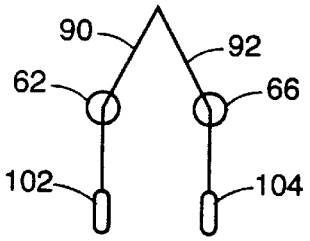
Figure 10C:
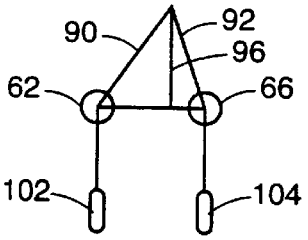
Figure 10D:
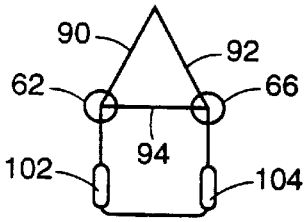
Figure 10E:
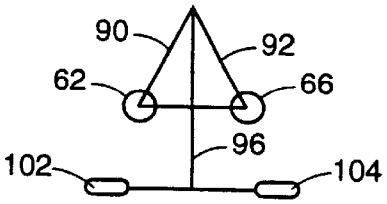

Applying the principles inherent in the embodiment of FIGS. 7, 8 and 9, many different frame configurations could be employed. A few alternative configurations for top frame 88 are shown in FIGS. 10A–10E. For example, pivoting rib 96 might be eliminated (FIG. 10A), or base 94 and rib 96 might be eliminated (FIG. 10B). In either case, an appropriate pivot joint at the junction of sliding vertical post 83 and the frame apex would be included. As another alternative, legs 90 and 92 might be of different lengths (FIG. 10C). If more rigidity were desired, extension arms 98 and 100 could be joined by a cross brace (FIG. 10D). In yet another version, rib 96 could extend beyond leg 94 with handles 102 and 104 located at the ends of a cross bar attached at right angles to the extension of rib 96 (FIG. 10E).

Additional joint configurations (e.g., universal), joint locations (e.g., at the intersection of base 94 and rib 96) and top frame designs are possible without departing from the spirit and the scope of this invention.

What we claim is:

1. A CPR device for alternating simultaneous compression of the thorax and decompression of the abdomen with simultaneous decompression of the thorax and compression of the abdomen, comprising:

a first pressure member for applying, alternatively, compressive forces and tensile forces;

a second pressure member for applying, alternatively, compressive forces and tensile forces; and a support beam, wherein said two pressure members are both attached to said support beam member and are separated from each other by a predetermined distance.

2. A device according to claim 1 wherein said distance between said first and second pressure members is about 8 inches.

3. A device according to claim 1 wherein said distance between said first and second pressure members is variable.

4. A device according to claim 1 wherein said first pressure member comprises a first air-tight sealing means for forming an air-tight seal when placed against said thorax and wherein said second pressure member comprises a second air-tight sealing means for forming an air-tight seal when placed against said abdomen.

5. A device according to claim 4 wherein said support beam has a first end and a second end and a first handle adjacent said first end and a second handle adjacent said second end.

6. A device according to claim 5 wherein said first and second pressure members are located between said first and second handles.

7. A device according to claim 6 wherein the distance between said first pressure member and said first handle is less than the distance between said second pressure member and said second handle.

8. A device according to claim 4 wherein said support beam has a mid-point and wherein said pressure members are asymmetrical with respect to said mid-point.

9. A device according to claim 4 wherein said support beam has a mid-point and wherein said pressure members are symmetrical with respect to said mid-point.

10. A device according to claim 1 wherein said first pressure member comprises a suction cup and said second pressure member comprises a suction cup.

11. A device according to claim 1 wherein said first pressure member has adhesive on one face thereof for attaching said first member to the thorax and said second pressure member has adhesive on one face thereof for attaching said second member to the abdomen.

12. A device according to claim 1 further comprising a force gauge monitoring means for monitoring a force applied to at least one of said first pressure member and said second pressure member.

13. A device according to claim 1 further comprising a backboard attached to said support beam and displaced from said support beam by a distance sufficient for an average person to fit therebetween.

14. A device according to claim 13 further comprising an extension arm connected to said support beam.

15. A device according to claim 1 further comprising means for varying the distance separating said first pressure member and said second pressure member.

16. A device according to claim 1 wherein said support beam is comprised of a sternal lever at one end and an abdominal lever at the opposite end and a connecting rod between said two levers.

17. A CPR device according to claim 1, wherein said first and said second pressure members are manually-operated.

18. A CPR device according to claim 1, wherein said first and said second pressure members are each driven by an external power source.

19. A CPR device according to claim 1, wherein said predetermined distance is approximately the distance between the thorax and the abdomen of an average person.

20. A method of performing CPR using the device of claim 1 comprising alternately applying compressive force to said first pressure member against said thorax followed by applying compressive force to said second pressure member against said abdomen.

21. The method of claim 20 further comprising the step of applying a decompressive force to said second pressure member simultaneously with said application of said compressive force to said first pressure member.

22. The method of claim 20 further comprising the step of applying a decompressive force to said first pressure member simultaneously with said application of said compressive force to said second pressure member.

23. The method of claim 21 further comprising the step of applying a decompressive force to said first pressure member simultaneously with said application of said compressive force to said second pressure member.

24. A method of performing CPR using the device of claim 5 comprising alternately applying force to said first handle followed by applying force to said second handle.

25. A system for resuscitating a victim in cardiac arrest comprising the device of claim 1 and means for providing defibrillation.

26. The system of claim 25 further comprising means for forced ventilation of a victim.

27. A system for resuscitating a victim in cardiac arrest comprising the device of claim 1 and means for forced ventilation of a victim.

* * * * *